US006865892B2

(12) United States Patent
Garrido et al.

(10) Patent No.: US 6,865,892 B2
(45) Date of Patent: Mar. 15, 2005

(54) COMBUSTION CHAMBER/VENTURI CONFIGURATION AND ASSEMBLY METHOD

(75) Inventors: Miguel Garrido, Palm Beach Gardens, FL (US); Shawn Miller, Palm City, FL (US)

(73) Assignee: Power Systems MFG, LLC, Jupiter, FL (US)

( * ) Notice: Subject to any disclaimer, the term of this patent is extended or adjusted under 35 U.S.C. 154(b) by 128 days.

(21) Appl. No.: 10/248,079

(22) Filed: Dec. 17, 2002

(65) Prior Publication Data

US 2004/0112058 A1 Jun. 17, 2004

(51) Int. Cl.[7] ..... F02C 7/20
(52) U.S. Cl. ..... 60/798; 60/752
(58) Field of Search ..... 60/798, 737, 738, 60/752, 754, 755, 756, 757, 758, 760, 805, 806

(56) References Cited

U.S. PATENT DOCUMENTS 5,117,636 A * 6/1992 Bechtel, II et al. ..... 60/738
6,427,446 B1 * 8/2002 Kraft et al. ..... 60/737
6,446,438 B1 * 9/2002 Kraft et al. ..... 60/737
6,484,509 B2 * 11/2002 Kraft et al. ..... 60/776
2003/0233832 A1 * 12/2003 Martling et al. ..... 60/776
2003/0233833 A1 * 12/2003 Martling et al. ..... 60/776

* cited by examiner

*Primary Examiner*—Justine Yu
*Assistant Examiner*—William H. Rodriguez
(74) *Attorney, Agent, or Firm*—Brian R. Mack

(57) ABSTRACT

A two-stage gas turbine combustor is disclosed that incorporates an improved assembly and disassembly methodology that results in improved inspection and repair techniques. The combustor includes an upper liner, lower liner, cap assembly, and a venturi assembly that directs cooling air into the combustion chamber for use in the combustion process, wherein a venturi assembly is inserted within an upper liner and an upper liner is then inserted in a lower liner. The venturi assembly, upper liner, and lower liner are fixed together with a plurality of easily removable retaining pins. The improved assembly allows for easier inspection and repair of the upper liner, lower liner, and venturi assembly.

11 Claims, 5 Drawing Sheets

COMBUSTION CHAMBER/VENTURI CONFIGURATION AND ASSEMBLY METHOD

BACKGROUND OF THE INVENTION

This invention relates generally to an apparatus for reducing nitric oxide (NOx) emissions in gas turbine combustion system. More specifically this invention relates to the apparatus and methodology for assembling the reduced NOx combustion system.

Combustion liners are commonly used in gas turbine engines to provide a protected environment for compressed air and fuel to mix and react in order to generate the hot gases necessary to drive a turbine. Due to the extreme exposure to elevated temperatures, combustion liners are typically coated with a thermal barrier coating (TBC) to reduce effects of high temperatures on the base metal of the combustion liner. Thermal barrier coating is typically comprised of a metallic bond coat and a ceramic top coat. Over time, exposure to elevated temperatures causes the TBC to erode and therefore necessitates inspection of the combustion liner and repair and replacement of worn liner elements, Including the thermal barrier coating. Typically, combustion liners can undergo multiple inspection and repair cycles at regular intervals before replacement of the combustion liner is required.

In some combustion liners additional hardware is present that must be removed before overhaul and maintenance function can be performed on a combustion liner. Examples include supports for fuel injectors or internal combustion chamber walls. More specifically, a two-stage combustion liner known in the art of gas turbine combustors used for power generation, includes a venturi that separates a first combustion chamber from a second combustion chamber. This venturi must be removed in order to repair and overhaul the surrounding combustion liner. An example of a prior art venturis installed within two-stage combustion liners are shown in FIGS. 1 and 2 and are described in detail in U.S. Pat. Nos. 5,117,636 and 6,446,438, respectively.

While two stage combustion systems are well known in the field of combustion technology, enhancements have been made to further reduce NOx emissions over prior art combustors. Early two stage combustors contained combustion liners with venturis similar to that disclosed in FIG. 1 and described in U.S. Pat. No. 5,117,636, where compressed air is employed to cool venturi walls 32 and exits passageway 44 in the downstream direction. Further development of two stage combustion technology led to a counter-flow venturi technology, as disclosed in U.S. Pat. No. 6,446,438 and shown in FIG. 2, where cooling air was redirected into a premix chamber 12 after cooling venturi assembly 11 and utilized in the combustion process. While this technology has advanced combustion systems to produce lower NOx emissions, it has created a configuration that demands a unique overhaul and repair sequence. The present invention provides a combustion liner configuration with improved assembly and disassembly methodology that results in improved inspection and repair techniques.

SUMMARY OF THE INVENTION

An improved combustion liner configuration is disclosed incorporating a unique assembly methodology for a combustion liner containing a venturi that utilizes venturi cooling air in the combustion process that allows for improved inspection and repair techniques. The combustion liner includes an upper liner, a lower liner, a cap assembly, and a venturi assembly. The cap assembly is fixed to the upper liner at a first upper end and the venturi assembly is inserted into the upper liner from a second upper end. The upper liner with cap assembly and venturi assembly is then inserted into a first lower end of the lower liner. A plurality of pins are inserted through the lower liner, upper liner, and venturi assembly in order to fix the venturi within the combustion liner. Providing the assembly point for the combustion liner proximate the venturi assembly allows for easier insertion and removal of the venturi assembly into the combustion liner as well as easier access to the combustion liner for inspection and repair of the thermal barrier coating.

DETAILED DESCRIPTION

Figure 1:
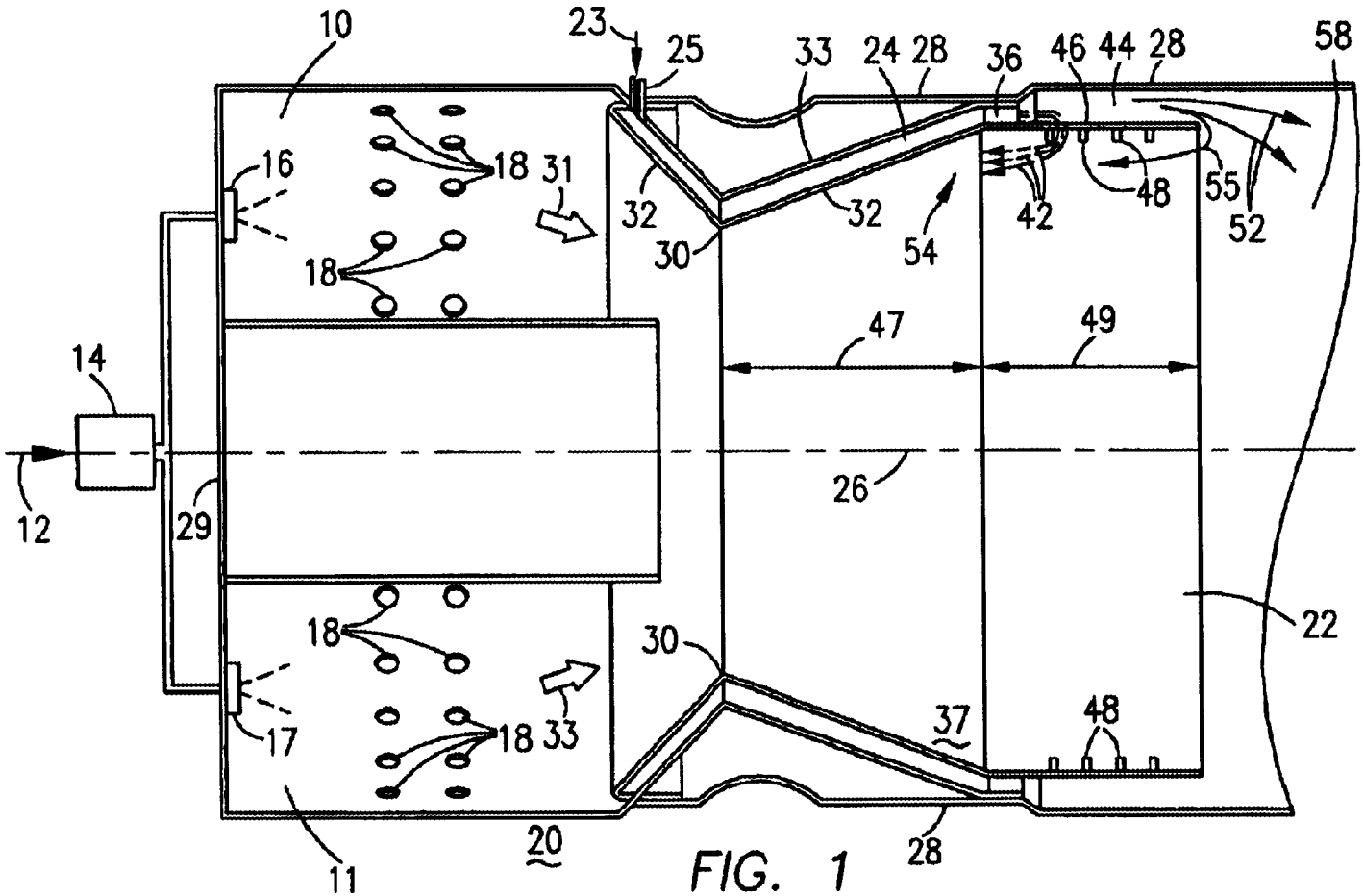
FIG. 1 PRIOR ART
FIG. 1 is a cross section view of a combustion liner and venturi of the prior art.
Figure 2:
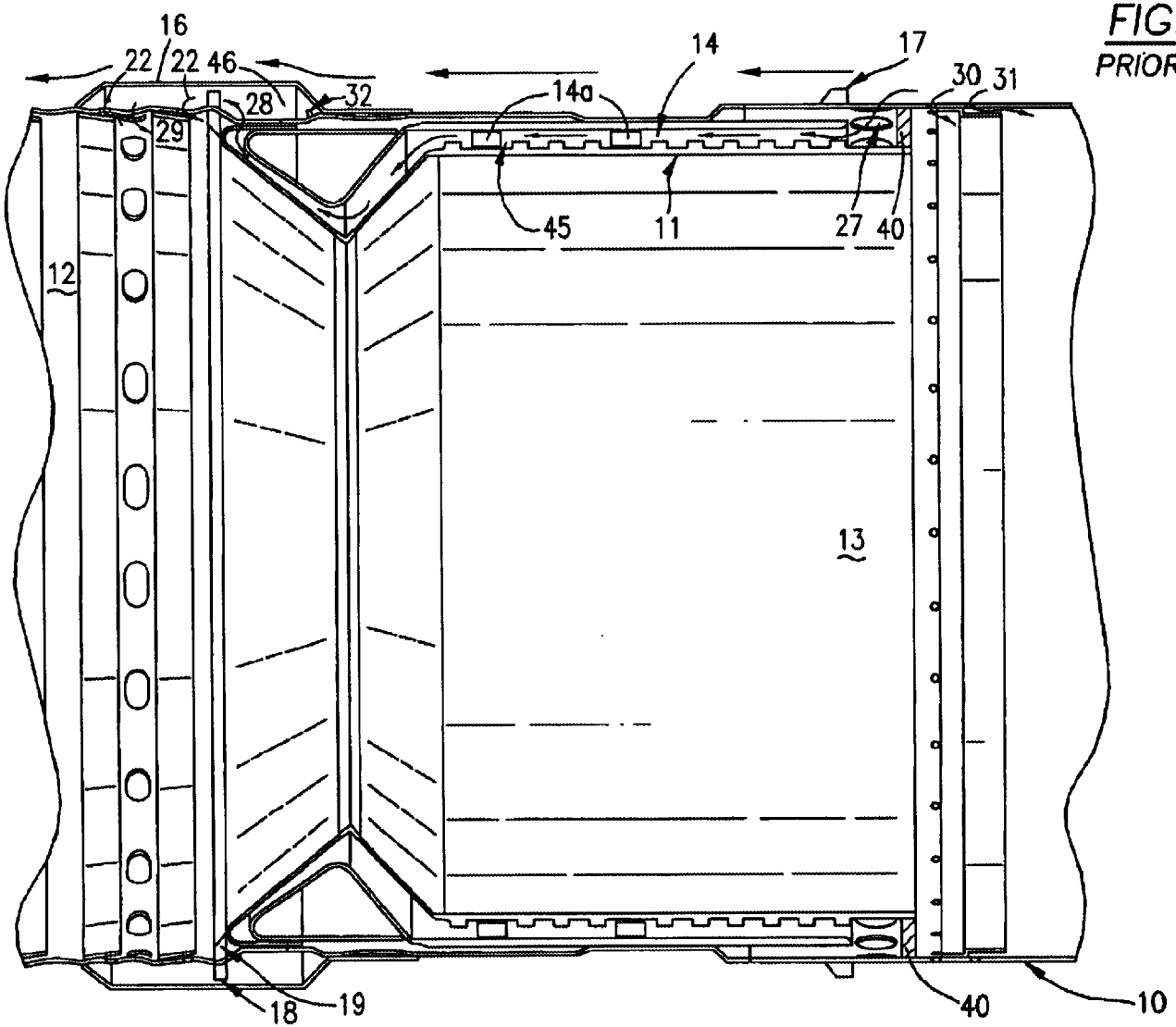
FIG. 2 PRIOR ART
FIG. 2 is a cross section view of an alternate combustion liner and venturi of the prior art.
Figure 3:
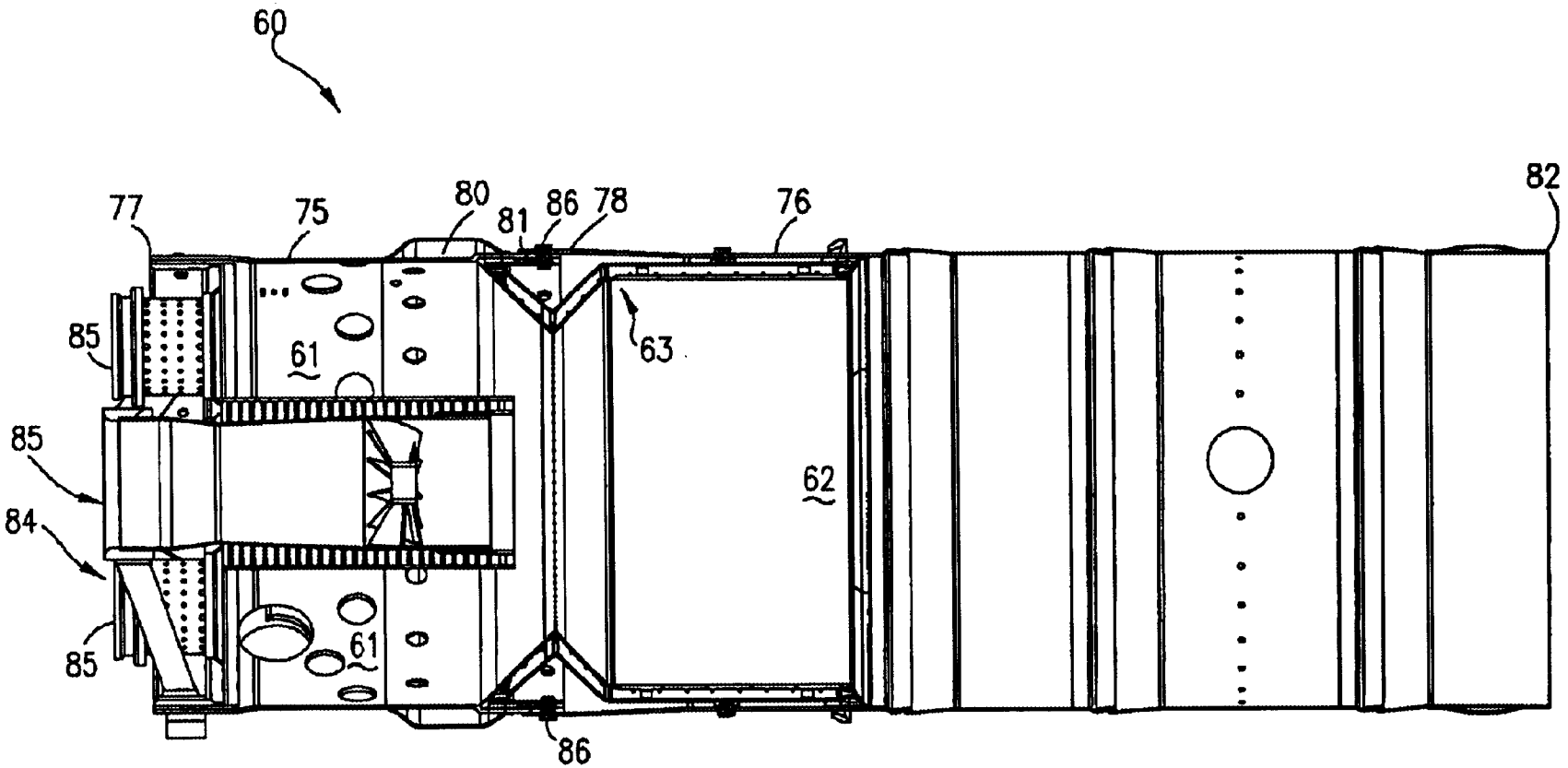
FIG. 3 is a cross section view of a combustion liner, cap assembly, and venturi assembly in accordance with the present invention.
Figure 4:
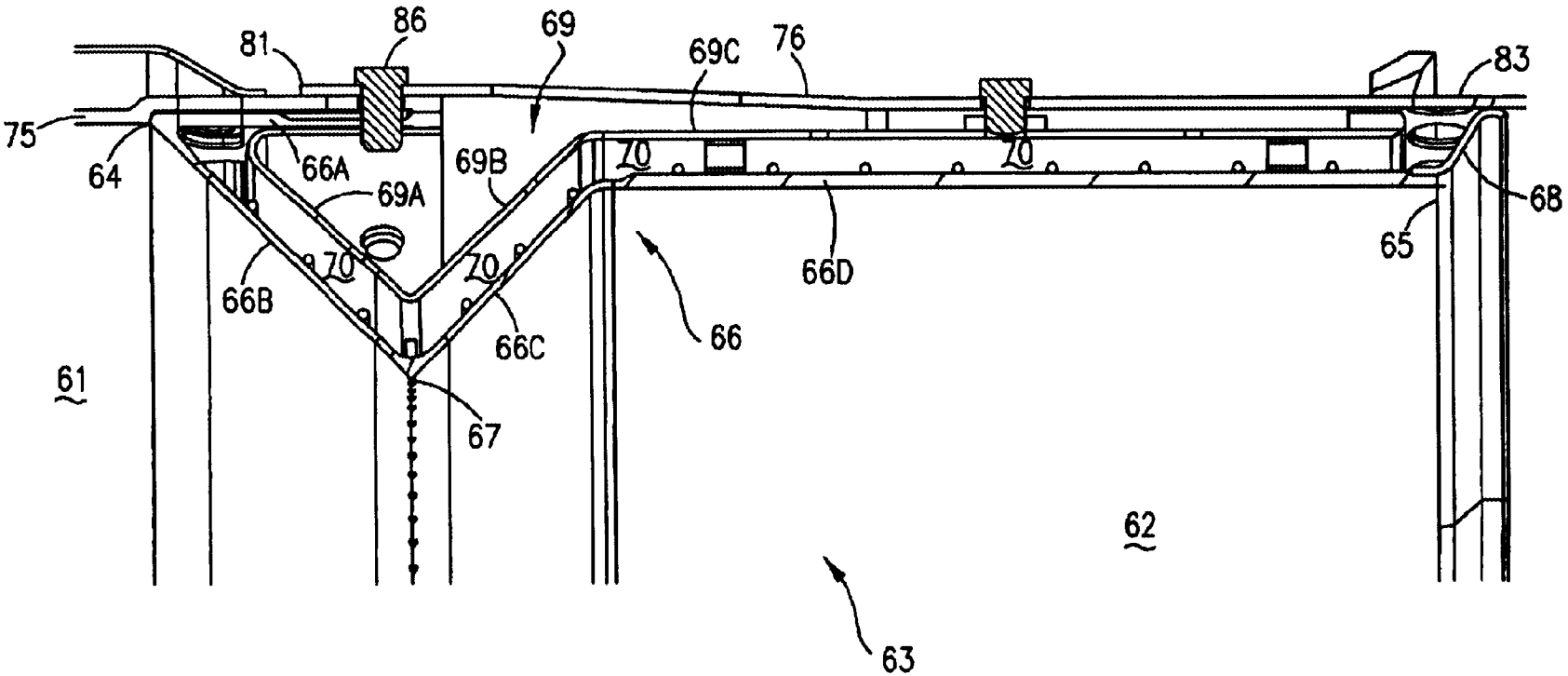
FIG. 4 is a detailed cross section view of a venturi assembly and portion of a combustion liner in accordance with the present invention.
Figure 5:
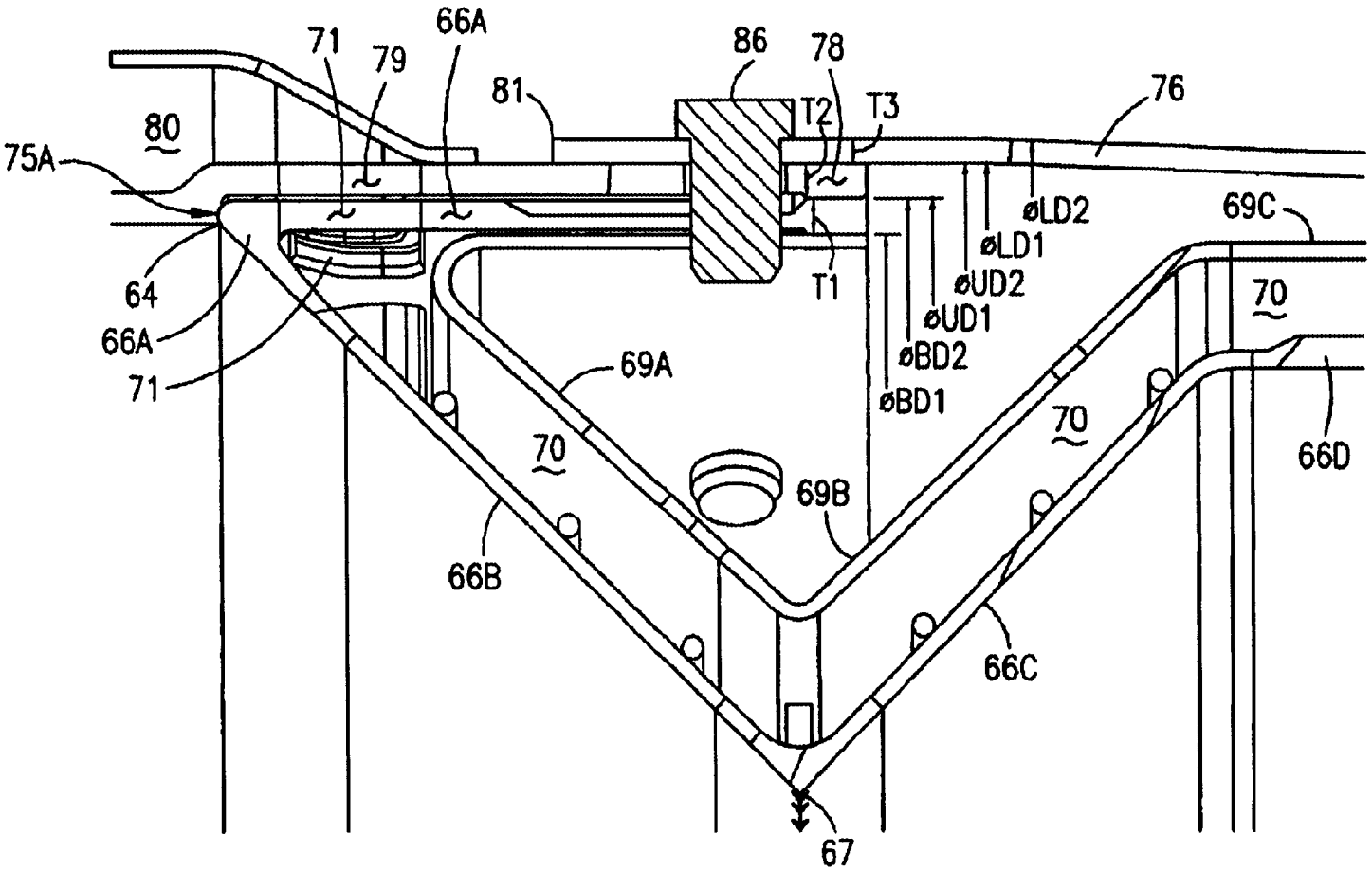
FIG. 5 is a detailed cross section view of the forward portion of a venturi assembly and a portion of a combustion liner in accordance with the present invention.

The present invention is shown in detail in FIGS. 3–5. A gas turbine combustor 60 contains a first combustion chamber 61 and a second combustion chamber 62 in fluid communication. Referring to FIG. 4, gas turbine combustor 60 further comprises a venturi assembly 63 having a first venturi end 64 proximate first combustion chamber 61 and a second venturi end 65 proximate second combustion chamber 62. Venturi assembly 63 also contains a flowpath wall 66 extending from first venturi end 64 to second venturi end 65 and having a first outer band 66A, a first convergent wall 66B, a first divergent wall 66C abutting first convergent wall 66B at a first throat 67, which is positioned axially between first combustion chamber 61 and second combustion chamber 62, and a first annular wall 66D extending from first divergent wall 66C. Fixed to first annular wall 66D, proximate second venturi end 65, is a blocking ring 68. Referring now to FIG. 5, first outer band 66A has a first band diameter BD1 and a second band diameter BD2 thereby forming a first thickness T1 therebetween.

Referring back to FIG. 4, venturi assembly 63 also contains a passageway wall 69 having a second convergent wall 69A, a second divergent wall 69B, and a second annular wall 69C in spaced relation to, and generally radially outward of, flowpath wall 66 thereby forming a first passageway 70 therebetween. First outer band 66A also contains a plurality of first holes 71 spaced circumferentially about first outer band 66A and in fluid communication with first passageway 70.

Gas turbine combustor 60 also includes an upper liner 75 and a lower liner 76, as shown in FIG. 3. Upper liner 75 is generally annular in shape and has a first upper end 77, a second upper end 78, a first upper diameter UD1, and a second upper diameter UD2, with first upper diameter UD1 and second upper diameter UD2 proximate second upper end 78 and defining a second thickness T2 therebetween.

Upper liner 75 also contains a plurality of second holes 79 spaced circumferentially about upper liner 75 such that they are in fluid communication with first holes 71 and a second passageway 80 radially outward of upper liner 75. Upper liner 75 further includes a venturi land 75*a* which acts as both a stop and a seal for venturi assembly 63, as shown in FIG. 5. Lower liner 76 is also generally annular in shape and has a first lower end 81 and a second lower end 82 as shown in FIG. 3. Referring back to FIG. 5, lower liner 76 also contains a first lower diameter LD1 and a second lower diameter LD2 with first lower diameter LD1 and second lower diameter LD2 proximate first lower end 78 and in spaced relation to first lower diameter LD1, thereby defining a third thickness T3 therebetween. Lower liner 76 also includes a plurality of third holes 83 circumferentially spaced about lower liner 76 proximate second venturi end 65 and in fluid communication with first passageway 70.

Referring back to FIG. 3, gas turbine combustor 60 further includes a cap assembly 84. In the preferred embodiment of the gas turbine combustor, cap assembly 84 contains multiple openings 85 for a plurality of fuel nozzles (not shown). Cap assembly 84 is fixed to upper liner 75 proximate first upper end 77. Typical means for assembling cap assembly 84 to upper liner 75 includes pins or welding.

Venturi assembly 63 is assembled to upper liner 75 and lower liner 76 in an easily removable manner by a plurality of retaining pins 86, typically at least six retaining pins, circumferentially spaced about combustor 60. First, venturi assembly 63 is inserted into upper liner 75 at second upper end 78 until first venturi end 64 contacts venturi land 75*a* and stops. Venturi assembly 63 with first outer band 66A is sized to be radially within upper liner 75 such that second band diameter BD2 is slightly less than first upper diameter UD1. Upper liner 75, which now contains venturi assembly 63, is then inserted into lower liner 76 at first lower end 81. This is possible since upper liner 75 which is sized to be radially within lower liner 76 has a second upper diameter UD2 slightly less than first lower diameter LD1. Venturi assembly 63, upper liner 75, and lower liner 76 are adjusted axially and circumferentially as necessary until retaining pins 86 can be inserted to secure the three components together. The plurality of retaining pins 86 pass through lower liner 76, upper liner 75, and first outer band 66A in order to adequately secure venturi assembly 63 to combustor 60 and secure lower liner 76 to upper liner 75. Venturi assembly 63 is positioned axially such that first venturi end 64 is in contact with upper liner 75 to form a seal to ensure that cooling air in first passageway 70 passes into second passageway 80. In addition, lower liner 76 may be intermittently welded to upper liner 75 proximate retaining pins 86 should additional structural support or sealing be required.

Providing a gas turbine combustor with above described structural configuration and assembly sequence allows for easy removal of the venturi assembly since the venturi assembly regions having tight tolerance dimensions will not have to pass along the majority of the combustor liner length in order for the venturi assembly to be installed or removed, as was required in the prior art. Furthermore, for combustors having a relatively long length, as in the preferred embodiment, splitting the combustor allows for easier inspection, repair, and overhaul tasks to be performed. This is especially true when liner sections require removal and reapplication of thermal barrier coating, which is typically performed by equipment with robotic arms that have limited mobility and reach.

What is claimed is:

1. A gas turbine combustor having a first combustion chamber in fluid communication with a second combustion chamber, said combustor comprising:

a venturi assembly comprising:

a first venturi end proximate said first combustion chamber and a second venturi end proximate said second combustion chamber;

a flowpath wall extending from said first venturi end to said second venturi end and having a first outer band, first convergent wall, first divergent wall, said first convergent wall abutting said first divergent wall at a first throat, a first annular wall extending from said first divergent wall, and a blocking ring fixed to said first annular wall, said first outer band having a first band diameter, a second band diameter, and a first thickness therebetween, said first throat positioned axially between said first and second combustion chambers;

a passageway wall having a second convergent wall, a second divergent wall, and a second annular wall in spaced relation to and radially outward of said flowpath wall thereby forming a first passageway there between;

a plurality of first holes spaced circumferentially about said first outer band, said first holes in fluid communication with said first passageway;

an upper liner generally annular in shape having a first upper end, a second upper end, a first upper diameter, and a second upper diameter, said first upper diameter and said second upper diameter proximate said second upper end defining a second thickness there between, a plurality of second holes circumferentially spaced about said upper liner and in fluid communication with said first holes and a second passageway radially outward of said upper liner;

a lower liner generally annular in shape having a first lower end, a second lower end, a first lower diameter, and a second lower diameter, said first lower diameter and said second lower diameter proximate said first lower end defining a third thickness there between, a plurality of third holes circumferentially spaced about said lower liner proximate said second venturi end, said third holes in fluid communication with said first passageway; and, a cap assembly for securing a plurality of fuel nozzles to said combustor, said cap assembly fixed to said upper liner proximate said first upper end;

wherein said venturi assembly is secured to said upper liner and said lower liner in an easily removable manner by a plurality of retaining pins such that said first outer band of said venturi is located radially within said upper liner and said upper liner is located radially within said lower liner.

2. The gas turbine combustor of claim 1 wherein said second band diameter is only slightly less than said first upper diameter.

3. The gas turbine combustor of claim 1 wherein said second upper diameter is only slightly less than said first lower diameter.

4. The gas turbine combustor of claim 1 wherein said first venturi end is in contact with said upper liner.

5. The gas turbine combustor of claim 1 wherein said plurality of retaining pins comprise at least six retaining pins.

6. The gas turbine combustor of claim 1 wherein each of said plurality of retaining pins passes through said lower liner, said upper liner, and said first outer band.

7. The gas turbine combustor of claim 1 wherein said lower liner is intermittently welded to said upper liner proximate said plurality of retaining pins.

8. A method of assembling a gas turbine combustor having a first combustion chamber in fluid communication with a second combustion chamber comprising the steps:

providing a venturi assembly comprising:

a first venturi end proximate said first combustion chamber and a second venturi end proximate said second combustion chamber;

a flowpath wall extending from said first venturi end to said second venturi end and having a first outer band, first convergent wall, first divergent wall, said first convergent wall abutting said first divergent wall at a first throat, a first annular wall extending from said first divergent wall, and a blocking ring fixed to said first annular wall, said first outer band having a first band diameter, a second band diameter, and a first thickness there between, said first throat positioned axially between said first and second combustion chambers;

a passageway wall having a second convergent wall, a second divergent wall, and a second annular wall in spaced relation to and radially outward of said flowpath wall thereby forming a first passageway there between;

a plurality of first holes spaced circumferentially about said first outer band, said first holes in fluid communication with said first passageway;

providing an upper liner generally annular in shape having a first upper end, a second upper end, a first upper diameter, and a second upper diameter, said first upper diameter and said second upper diameter proximate said second upper end defining a second thickness therebetween, a plurality of second holes circumferentially spaced about said upper liner and in fluid communication with said first holes and a second passageway radially outward of said upper liner;

providing a lower liner generally annular in shape having a first lower end, a second lower end, a first lower diameter, and a second lower diameter, said first lower diameter and said second lower diameter proximate said first lower end defining a third thickness there between, a plurality of third holes circumferentially spaced about said lower liner proximate said second venturi end, said third holes in fluid communication with said first passageway;

providing a cap assembly for securing a plurality of fuel nozzles to said combustor;

inserting said venturi assembly into said upper liner at said second upper end;

inserting said upper liner into said lower liner at said first lower end;

securing said venturi assembly to said upper liner and said lower liner with a plurality of retaining pins spaced circumferentially about said combustor; and, securing said cap assembly to said upper liner proximate said first upper end.

9. The method of assembling a gas turbine combustor according to claim 8 wherein said plurality of retaining pins comprise at least six retaining pins.

10. The method of assembling a gas turbine combustor according to claim 8 wherein each of said plurality of retaining pins passes through at least said lower liner, said upper liner, and said first outer band.

11. The method of assembling a gas turbine combustor according to claim 8 further comprising the step of intermittently welding said lower liner to said upper liner proximate said retaining pins after said venturi assembly is secured to said upper liner and said lower liner with said retaining pins.

* * * * *